United States Patent [19]

Wilson et al.

[11] Patent Number: 4,560,359

[45] Date of Patent: Dec. 24, 1985

[54] WATCH AND PLAY ACTIVITY KIT

[75] Inventors: Angele Wilson; John Wilson, both of Studio City, Calif.

[73] Assignee: Direct Broadcast Programs Inc., Studio City, Calif.

[21] Appl. No.: 591,797

[22] Filed: Mar. 21, 1984

[51] Int. Cl.[4] ..... A63H 33/04; A63J 19/00

[52] U.S. Cl. ..... 446/75; 446/83

[58] Field of Search ..... 446/82, 83, 84, 487, 446/488, 219, 478, 73, 75, 79, 80, 71, 146, 147, 151, 152; 229/DIG. 3, 446

[56] References Cited

U.S. PATENT DOCUMENTS 646,638 4/1900 Cutler ..... 229/DIG. 3
1,523,283 1/1925 Powers ..... 446/82 X

FOREIGN PATENT DOCUMENTS 2298353 8/1976 France ..... 446/82
713980 8/1954 United Kingdom ..... 446/82

*Primary Examiner*—Mickey Yu
*Attorney, Agent, or Firm*—Larson and Taylor

[57] ABSTRACT

A self-contained watch and play activity kit is disclosed which includes a puppet theater having a front and two sides. The front includes a transparent portion through which the interior of the theater is visible. The sides are foldable about weakened first fold lines parallel to the front to form an enclosed theater container in which a central space is provided. A removable insert is sized to be snugly received in the central space of the folded theater container. The insert includes a video cassette holder. The insert further forms a compartment with the folded theater container in which various props for the theater and elements of the kit are stored. The sides also include weakened second fold lines so that the rearward portions of the sides are folded to form a back of the theater. In order to provide access to the inside of the theater, removable panels are located in each side. The activity kit includes a video cassette which contains instructions for using the kit including a story, puppet characters and scenery in a coloring book, crayons for coloring in the coloring book, and scissors for cutting the puppets or the like from the coloring book. Elongate sticks are further provided for attachment to the puppets to manipulate the puppets in the theater.

10 Claims, 5 Drawing Figures

WATCH AND PLAY ACTIVITY KIT

FIELD OF THE INVENTION

The present invention relates generally to activity kits for children, and more particularly to a self-contained activity kit which unfolds into a puppet theater and which contains a video cassette and suitable props for telling a story in the theater.

BACKGROUND OF THE INVENTION

There have been disclosed in the prior art a number of foldable puppet theaters or the like. For example, in U.S. Pat. No. 2,083,586 (Edelman), a foldable model display stage which takes the form of a compact box in which all of the provided parts of the stage and props are located is disclosed. In U.S. Pat. No. 2,837,863 (Duvall), a puppet stage which is readily collapsed into a compact carrying carton in which the puppets and stage props are packed is disclosed. When assembled, the puppet stage has an open back which is covered by a split curtain. When the stage is folded into the shape of a box, the side wing panels are folded parallel to and spaced from the front to form a space in which puppets and stage props are conveniently stored. A collapsible theater is also disclosed in U.S. Pat. No. 1,583,775 (Brandt).

SUMMARY OF THE INVENTION

A self-contained watch and play activity kit is provided which includes a puppet theater having a vertical rectangular front and two vertical rectangular sides extending rearwardly from the front. The front includes a transparent portion through which the interior of the theater is visible. The sides are foldable with respect to the front so that an enclosed theater container having a central space is provided. A removable insert in located in the theater container and is sized to be snugly received in the central space. The insert includes a video cassette holding means for holding a video cassette relative to the insert. The insert also forms compartments with the folded theater in which various props for the theater are stored.

In a preferred embodiment of the present invention, the theater also includes a short rectangular top and a short rectangular bottom which are attached to the front. The sides includes a weakened first fold line passing adjacent the rearward corners of the respective tops and bottoms so that the sides are foldable along the first fold lines parallel to the front to form the back of the collapsed theater container. In addition, the sides each include a weakened second fold line which is parallel to the first fold line and located at an intermediate position between the first fold line and the back edge of the respective sides. By folding these sides inwardly along the second fold lines, a back for the theater is provided. A means for holding the respective back edges of the sides adjacent one another after folding along the second fold lines is also provided. In order to provide access to the inside of a theater, removable panels are located in each side between the first fold lines and second fold lines.

Preferably, the insert is generally planar and the means for holding the video cassette is a central rectangular depression in which the video cassette is snugly received. The insert is generally parallel to the front and is spaced intermediate the front and first fold lines by the cassette in the depression. In this manner, two compartments are provided on either side of the depression in which the various props can be stored. In addition, the insert also includes a scissors holding means and a crayon box holding means.

The video cassette preferably contains instructions for using the activity kit, including a story which can be acted out in the puppet theater using puppets of the story which are provided with the kit. The video cassette can also contain instructions for setting up the puppet theater. Preferably, a coloring book is included in the kit which contains the puppets which are used with the story. Crayons for coloring the puppets in the coloring book and scissors for cutting the puppets from the coloring book are also included. Finally, elongate sticks such as straws are included which are attached to the puppets at one end so that a user grasping the other end can manipulate the puppets in the theater.

It is a feature of the present invention that a self-contained watch and play activity kit is provided in an enclosed theater container which includes all the necessary props and other accesories.

It is also a feature of the present invention that the self-contained theater container is openable and foldable into a puppet theater, and subsequently reclosable into an enclosed theater container.

It is a further feature of the present invention that the video cassette supplied with the activity kit contains instructions for setting up and using the activity kit including a story complementary to the props associated with the activity kit.

Other features and advantages of the present invention are stated in or apparent from a detailed description of a presently preferred embodiment of the invention found hereinbelow.

DETAILED DESCRIPTION OF THE PREFERRED EMBODIMENT

Figure 1:
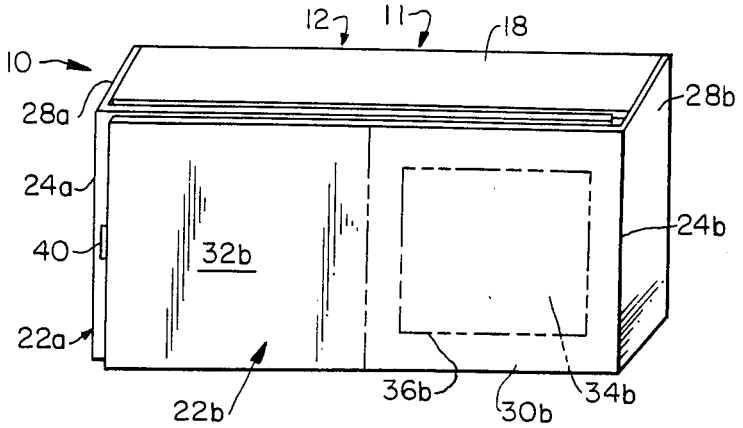
FIG. 1 is a rear perspective view of the enclosed theater container according to the present invention.
Figure 2:
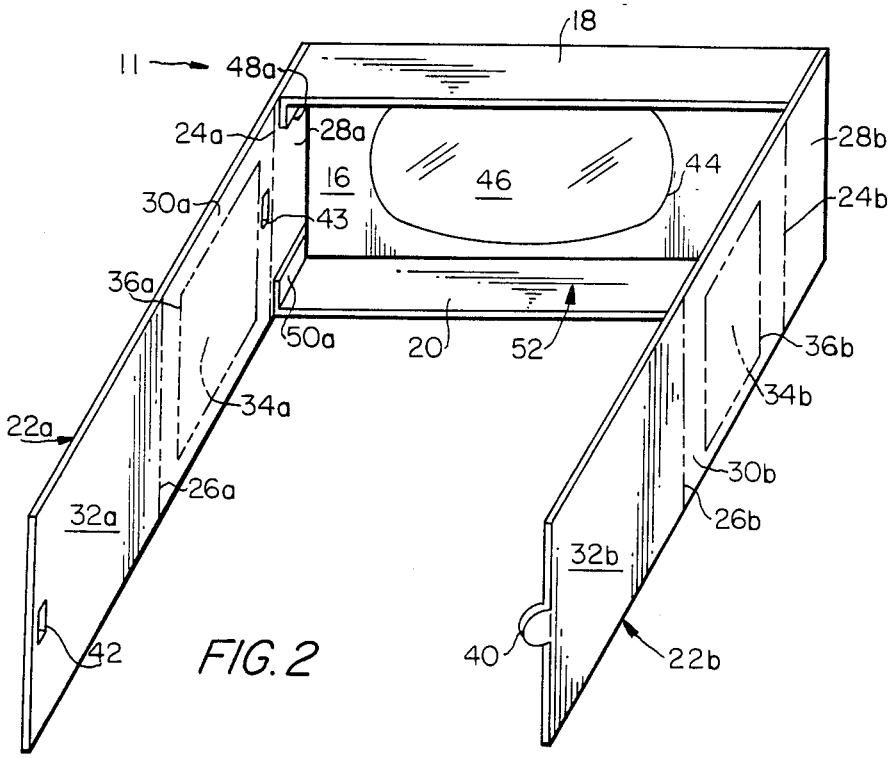
FIG. 2 is a rear perspective view of the theater container depicted in FIG. 1 which has been opened up.
Figure 3:
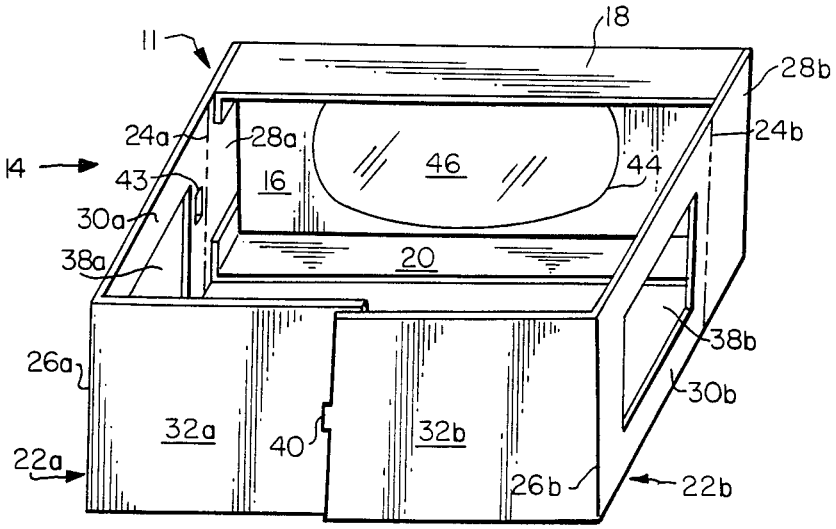
FIG. 3 is a rear perspective view of the puppet theater which has been constructed from the theater container depicted in FIGS. 1 and 2.

With reference now to the drawings in which like numerals represent like elements throughout the several views, a presently preferred embodiment of a self-contained watch and play activity kit 10 according to the present invention is depicted in FIGS. 1 to 5. As shown best in FIGS. 1 and 4, activity kit 10 includes a cardboard structure 11 which is initially provided as an enclosed theater container 12 and which is subsequently opened to form a puppet theater 14 as shown in FIG. 3.

Structure 11 includes a front 16, a top 18, a bottom 20, and sides **22*a* and 22*b*. Sides 22*a* and 22*b* are broken into three panels by weakened fold lines 24*a*, 24*b*, 26*a*, and 26*b*. Thus, sides 22*a* and 22*b* include side panels 28*a* and 28*b*, intermediate panels 30*a* and 30*b*, and rear panels 32*a* and 32*b*, respectively. Intermediate panels 30 are initially provided with removable panels 34*a* and 34*b* defined by perforated or weakened lines 36*a* and 36*b***.

When removable panels 34*a* and 34*b* are removed from intermediate panels 30*a* and 30*b*, openings 38*a* and 38*b* are respectively provided.

As shown best in FIG. 2, rear panel 32*b* is provided with a tab 40 which extends from the back end of rear panel 32*b*. At a similar vertical position near the back edge, rear panel 32*a* is provided with a slot 42 which is sized to snugly receive tab 40. In addition, a similar slot 43 is also provided adjacent fold line 24*a* in intermediate panel 30*a*. Slot 43 is similarly sized to snugly receive tab 40 therein.

Figure 5:
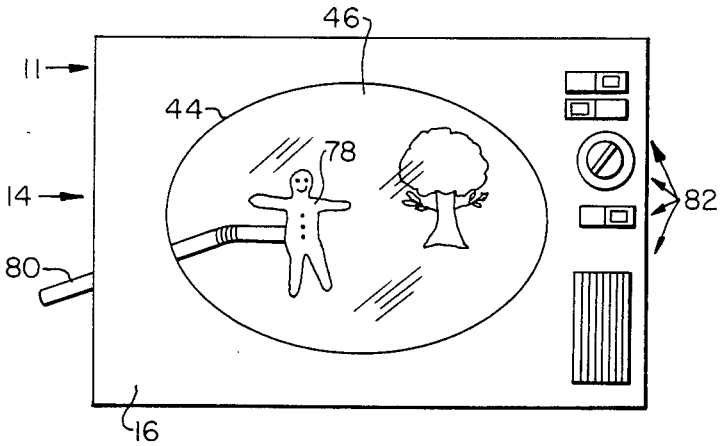
FIG. 5 is a front elevation view of the puppet theater depicted in FIG. 3.

Front 16 is provided with a central oval shaped opening 44 which is covered by a suitable transparent material 46. As shown in FIG. 5, front 16 is conveniently provided with indicia 82 to imitate the appearance of a television screen. As structure 11 is made of a convenient cardboard material, top 18 and bottom 20 are conveniently attached to respective side panels 28*a* and 28*b* by suitable flaps such as flaps 48*a* and 50*a* shown in FIGS. 2 and 3. Glue or staples make a suitable attaching means for flaps 48*a* and 50*a*.

In operation, theater container 12 is unfolded in the following manner to create puppet theater 14. Initially, it should be appreciated that theater container 12 is provided in the form shown in FIG. 1 with side 22*a* folded along fold line 24*a* so that intermediate panel 30*a* and rear panel 32*a* are parallel to front 16 and extend substantially all the way across to side panel 28*b*. Similarly, side 22*b* is folded around fold line 24*b* so that intermediate panel 30*b* and rear panel 32*b* are parallel to front 16 and overlie rear panel 32*a* and intermediate panel 30*a*, respectively. The rearward end of rear panel 32*b* extends substantially to side panel 28*a* and is located at a position such that tab 40 is received in slot 43. This holds rear panel 32*b* and intermediate panel 30*b* against intermediate panel 30*a* and rear panel 32*a*. Therefore, in conjunction with front 16, top 18, bottom 20, and side panels 28*a* and 28*b*, intermediate panels 30*a* and 30*b* and rear panels 32*a* and 32*b* form enclosed theater container 12. It should also be appreciated that a central space 52 is enclosed by theater container 12.

In order to form enclosed theater container 12 into puppet theater 14, tab 40 is first removed from slot 43. Next, intermediate panel 30*b* and rear panel 32*b* are initially unfolded along fold line 24*b* to a position where panels 30*b* and 32*b* are parallel to side panel 28*b*. Similarly, panels 32*a* and 34*a* are unfolded along fold line 24*a* so as to be parallel to side panel 28*a*. At this stage, theater container 12 appears as shown in FIG. 2.

Next, rear panel 32*a* is folded along fold line 26*a* so as to be parallel to front 16. Similarly, rear panel 32*b* is folded along fold line 26*b* so as to be parallel to front 16. Tab 40 is then inserted in slot 42 to hold rear panels 32*a* and 32*b* together. Finally, removable panels 34*a* and 34*b* are torn or separated from respective intermediate panels 30*a* and 30*b* to form openings 38*a* and 38*b*, respectively. When this is accomplished, puppet theater 14 as depicted in FIG. 3 is substantially complete.

It should be appreciated that activity kit 10 further includes an insert 60 which contains various props and the like within central space 52 of theater container 12. As shown best in FIG. 4, insert 60 is generally planar with a rectangular depression 62 in the center thereof. On either side, insert 60 includes legs 64*a* and 64*b* which extend parallel to side panels 28*a* and 28*b*, respectively. As shown, insert 60 is sized to be snugly received within central space 52. In addition, insert 60 divides central space 52 horizontally into two parts.

Rectangular depression 62 is designed to received a standard size video cassette 64 therein. As video cassette 64 is viewable through opening 44 in front 16, video cassette 64 is preferably covered with suitable indicia indicating the story line of activity kit 10. Video cassette 64 further serves to space insert 60 from front wall 16. Video cassette 64 also divides that portion of central space 52 between front 16 and insert 60 into compartments 66*a* and 66*b*. As shown, crayons 68 are provided in compartment 66*a* and are attached to insert 60 by a suitable attaching means such as rubber band 70. In compartment 66*b*, scissors 72 are similarly attached to insert 60.

Located between rectangular depression 62 and the portions of sides 22*a* and 22*b* parallel to front 16 is a coloring book 74. As shown, coloring book 74 substantially extends from side panel 28*a* to side panel 28*b*. Thus, coloring book 74 and insert 60 further divide central space 62 into compartments 76*a* and 76*b*. Located in compartment 76*a* are suitable props or the like for puppet theater 14 such as paper puppet 78 depicted. On the other side in compartment 76*b*, elongate sticks such as drinking straws 80 or the like are provided. Preferebly, drinking straws 80 include a bendable section formed by a series of pleats so that straws 80 can be bent to any desired angle and maintained in that position.

As shown in FIG. 5, front 16 is designed to resemble the front of a television. Thus, opening 44 is generally oval shaped and indicia 82 are provided on one side of opening 44 which resemble the knobs, switches, and speaker cover normally found on the front of a television. Also shown is paper puppet 78 which has been attached to a drinking straw 80 and positioned in front of opening 44. It should be appreciated that drinking straw 80 extends through opening 38*b* in puppet theater 14. An additional tree prop is further shown in theater 14 and forms suitable scenery.

Figure 4:
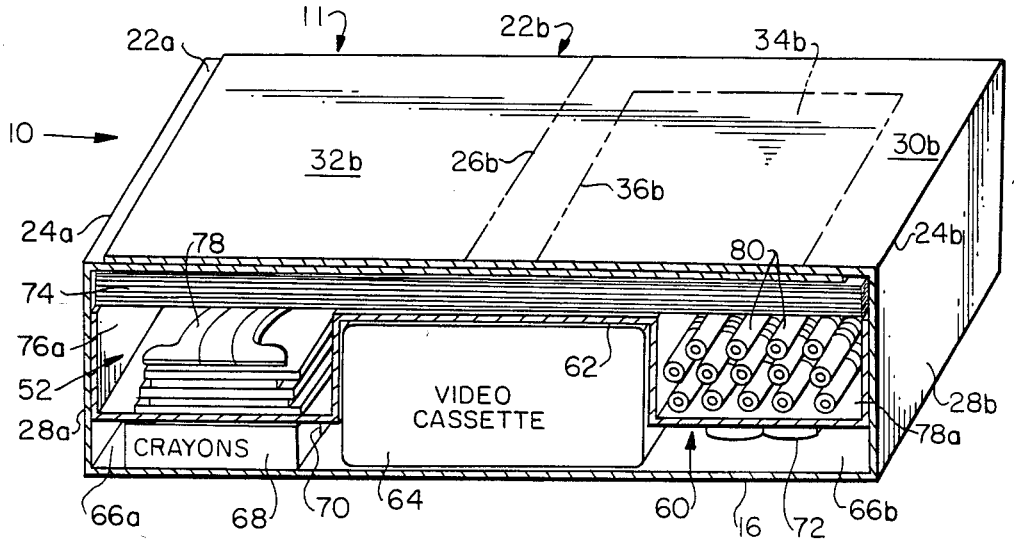
FIG. 4 is a bottom perspective view in cross section of the theater container depicted in FIG. 1.

The operation of activity kit 10 is as follows. Initially, as described above, structure 11 is folded into theater container 12 as shown in FIG. 1 and contains insert 60 and the various elements associated with insert 60 as shown in FIG. 4. Upon opening theater container 12 as shown in FIG. 2, insert 60 and the various elements are removed and puppet stage 14 is formed as described above. Preferably, video cassette 64 is immediately removed from insert 60 and inserted in a tape player so that instructions for setting up puppet theater 14 are viewed by the user on an associated television. Next, video cassette 64 instructs the user to color the various props including paper puppet 78 which are conveniently found in coloring book 74. Crayons 68 are included in activity 10 and are easily removed from insert 60 where crayons 68 are held by rubber band 70. After coloring the various props, such as paper puppet 78 and background scenery, video cassette 64 instructs the user to cut the various props from coloring book 74 using scissors 72 which are also provided with activity kit 10 attached to insert 60. Finally, video cassette 64 instructs the user to attach drinking straws 80 or the like to the various props and paper puppets 78 for subsequent use with puppet theater 14.

After puppet theater 14 has been formed and the various props constructed, video cassette 64 proceeds to tell a story associated with the characters and props found in coloring book 74. Examples of suitable stories are Peter Rabbit, Pinocchio, Peter Pan, or the like. As the story is told and pictured by video cassette 64 on the associated television screen, the user can mimic the action in puppet theater 14. Additionally, after the story has been told by video cassette 64, the user can retell the story using puppet theater 14 or invent variations or a new story using the various props and paper puppet 78.

When the user is finished playing with activity kit 10, puppet theater 14 is folded in the opposite manner in which it was constructed from theater container 12 to again form theater container 12. In addition, video cassette 64, crayons 68, scissors 72, coloring book 74, drinking straws 80, and the various props including puppet 78 are relocated with respect to insert 60, and insert 60 together with the various elements is again inserted in central space 62 of theater container 12 prior to the closing of sides 22*a* and 22*b*. To ensure that theater container 12 is kept shut to retain insert 60 in the various elements in central space 52, tab 40 is finally inserted in slot 43. In this manner, theater container 12 provides a convenient storage container for activity kit 10 so that activity kit 10 is easily used subsequently.

It should be appreciated that even though removable panels 34*a* and 34*b* have been removed from sides 22*a* and 22*b* theater container 12 still encloses the central space 52 due to the fact that rear panel 32*a* overlies opening 38*b* created where removable panel 34*b* was removed, and that rear panel 32*b* overlies opening 38*a* created where removable panel 34*a* was removed.

Although the present invention has been described with respect to an exemplary embodiment thereof, it will be understood by those of ordinary skills in the art that variations and modifications can be effected within the scope and spirit of the invention.

We claim:

1. A self-contained watch and play activity kit comprising:

a foldable structure which is expanded to form a puppet theater and which is collapsed to form a theater container, said structure having a vertical rectangular front, a short rectangular top and a short rectangular bottom which are attached to said front and two vertical rectangular sides extending rearwardly from said front; said front including a transparent portion through which the interior of the puppet theater is visible; and said sides being foldable with respect to said front such that said enclosed theater container has a central space therein, and wherein said sides include a weakened first fold line passing adjacent the rearward corners of respective said tops and bottoms such that said sides are folded along said first fold lines parallel to said front to form the back and sides of the collapsed theater container, and wherein said sides further include a weakened second fold line parallel to said first fold line and located at an intermediate position between said first fold line adjacent the rearward corners of said tops and bottoms and the back edge of said respective side such that by folding said sides inwardly along said second fold lines a back for said puppet theater is produced; and a removable insert which is sized to be snugly received in the central space of said folded theater container and thereby held relatively immovably therein, said insert including a video cassette holding means for holding a video cassette relative to said insert, said insert further forming a closed compartment with said folded theater container in which various props for the puppet theater are stored.

2. An activity kit as claimed in claim 1 and further including an attaching means for holding respective back edges of said sides adjacent one another after folding along said second fold lines.

3. An activity kit as claimed in claim 2 wherein said attaching means is a slot in one respective said side adjacent the back edge and a tab extending form the back edge of the other respective said side which is snugly received in said slot.

4. An activity kit as claimed in claim 2 and further including a removable panel located in each said side between respective said first fold lines and said second fold lines whereby the removal of said removable panels provide openings by which puppets or the like are passed through said sides and are viewable through said front.

5. An activity kit as claimed in claim 4 wherein said insert is generally planar and said holding means is a central rectangular depression in which the video cassette is snugly received.

6. An activity kit as claimed in claim 5 wherein said insert is generally parallel to said front and spaced intermediate said front and said first fold lines by the video cassette in said depression such that there are two of said compartments formed with the folded theater container which are located on either side of said depression.

7. An activity kit as claimed in claim 6 wherein said insert further includes a scissors holding means for holding a pair of scissors thereto and a crayon holding means for holding a box of crayons thereto.

8. An activity kit as claimed in claim 1 and further including a video cassette containing instructions for using the activity kit including a story, and puppet characters from the story for use in said theater.

9. An activity kit as claimed in claim 8 wherein said video cassette also includes instructions for setting up said theater.

10. An activity kit as claimed in claim 9 and further including a coloring book containing said puppets, crayons for coloring said puppets in said coloring book, scissors for cutting said puppets from said coloring book, and elongate sticks which are attachable to said puppets at one end whereby a user grasps the other end and manipulates said puppets in said theater.

* * * * *